US008596738B2

(12) United States Patent
Kim et al.

(10) Patent No.: US 8,596,738 B2
(45) Date of Patent: Dec. 3, 2013

(54) MONITORING APPARATUS FOR INKJET HEAD

(75) Inventors: Byung Hun Kim, Gyunggi-do (KR); Seung Joo Shin, Seoul (KR)

(73) Assignee: Samsung Electro-Mechanics Co., Ltd., Suwon (KR)

( * ) Notice: Subject to any disclaimer, the term of this patent is extended or adjusted under 35 U.S.C. 154(b) by 255 days.

(21) Appl. No.: 12/926,822

(22) Filed: Dec. 10, 2010

(65) Prior Publication Data

US 2011/0193903 A1 Aug. 11, 2011

(30) Foreign Application Priority Data

Feb. 8, 2010 (KR) ..... 10-2010-0011580

(51) Int. Cl.
*B41J 29/38* (2006.01)
*B41J 29/393* (2006.01)
*B41J 2/045* (2006.01)

(52) U.S. Cl.
USPC ..... 347/9; 347/10; 347/11; 347/19; 347/68

(58) Field of Classification Search
USPC ..... 347/19, 9–11, 68
See application file for complete search history.

(56) References Cited

U.S. PATENT DOCUMENTS

2006/0038858 A1 2/2006 Ishizaki
2007/0279446 A1 12/2007 Ishizaki

FOREIGN PATENT DOCUMENTS

EP 1790484 A2 5/2007
JP 2007-326237 12/2007
KR 10-2008-0053737 6/2008
KR 10-2009-0065179 6/2009

OTHER PUBLICATIONS

Korean Office Action dated Nov. 2, 2011 issued in corresponding Korean Patent Application No. 10-2010-0011580.

*Primary Examiner* — Jason Uhlenhake

(57) ABSTRACT

There is provided a monitoring apparatus for an inkjet head including a resistance element connected between a driving circuit generating a driving signal and a piezoelectric element applying pressure to an ink chamber according to the driving signal, an amplifier unit amplifying a differential voltage between an output voltage from the driving circuit and a voltage generated in the piezoelectric element, and a detecting unit detecting whether ink is being normally ejected, based on the amplified differential voltage from the amplifier unit.

7 Claims, 7 Drawing Sheets

MONITORING APPARATUS FOR INKJET HEAD

CROSS-REFERENCE TO RELATED APPLICATIONS

This application claims the priority of Korean Patent Application No. 10-2010-0011580 filed on Feb. 8, 2010, in the Korean Intellectual Property Office, the disclosure of which is incorporated herein by reference.

BACKGROUND OF THE INVENTION

1. Field of the Invention

The present invention relates to a monitoring apparatus for an inkjet head, and more particularly, to a monitoring apparatus for an inkjet head, capable of sensing the vibration of the inkjet head after the ejecting of ink, to thereby defect whether the inkjet head is defective and to detect whether a head driver is abnormal, based on vibration waveform in the inkjet head.

2. Description of the Related Art

Recently, a piezoelectric type of inkjet head has been used for an industrial inkjet printer. For example, the piezoelectric type of inkjet head is used to directly form a circuit pattern by spraying ink produced by melting a metal such as gold, silver or the like onto a printed circuit board (PCB), create industrial graphics, or to manufacture a liquid crystal display (LCD), an organic light emitting diode (OLED), a solar cell, or the like.

This piezoelectric type of inkjet head may include a pressure chamber, a nozzle, a flow path, and a piezoelectric actuator generating driving pressure. In general, the piezoelectric actuator is closely adhered to an outside portion of the inkjet head corresponding to the circumference of the pressure chamber. By the change in displacement of the piezoelectric actuator to which an electric signal is applied, pressure generated by the piezoelectric actuator is transferred to the pressure chamber, so that a liquid droplet is ejected from the nozzle.

However, since the nozzle of the inkjet head is exposed to the air, the air may tend to flow into the inside of the head through a surface of the nozzle on which ink and the air come into contact with each other. This inflow of air may greatly reduce pressure generated by the piezoelectric actuator and cause the ejecting of the liquid droplet from the nozzle to be stopped. Like this, since the abnormal ejecting of ink may significantly affect the quality of the printing being performed, it is important to promptly detect a nozzle from which ink is being abnormally ejected.

The piezoelectric actuator receives an electric signal and converts the received electric signal into pressure, in order to eject ink from the nozzle. Conversely, when receiving pressure from the outside, the piezoelectric actuator generates an electric signal. Therefore, a piezoelectric element used as the piezoelectric actuator may also be used as a sensor capable of determining whether ink is being normally ejected from the nozzle by sensing the vibration of the inkjet head after the ejecting of ink.

SUMMARY OF THE INVENTION

An aspect of the present invention provides a monitoring apparatus for an inkjet head, capable of determining whether ink is being normally ejected by sensing the vibration of the inkjet head after the ejecting of ink by using a piezoelectric element used as an actuator allowing for the ejecting of the ink.

According to an aspect of the present invention, there is provided a monitoring apparatus for an inkjet head including: a resistance element connected between a driving circuit generating a driving signal and a piezoelectric element applying pressure to an ink chamber according to the driving signal; an amplifier unit amplifying a differential voltage between an output voltage from the driving circuit and a voltage generated in the piezoelectric element; and a detecting unit detecting whether ink is being normally ejected, based on the amplified differential voltage from the amplifier unit.

The detecting unit may detect whether the ink is being normally ejected from the nozzle, by comparing the amplified differential voltage from amplifier unit with a previously inputted differential voltage of the amplifier unit when the ink is being normally ejected.

The detecting unit may detect whether the ink is being normally ejected, based on the amplified differential voltage from the amplifier unit after the piezoelectric element is driven according to the driving signal.

According to another aspect of the present invention, there is provided a inkjet printer including: a driving circuit generating a driving signal; a piezoelectric element applying pressure to an ink chamber according to the driving signal; a resistance element connected between the driving circuit and the piezoelectric element; an amplifier unit amplifying a differential voltage between an output voltage of the driving circuit and a voltage generated in the piezoelectric element; and a detecting unit detecting whether ink is being normally ejected, based on the amplified differential voltage from the amplifier unit.

The detecting unit may detect the ink is being normally ejected from the nozzle, by comparing the amplified differential voltage from amplifier unit with a previously inputted differential voltage of the amplifier unit when the ink is being normally ejected.

The detecting unit may detect whether the ink is being normally ejected, based on the amplified differential voltage from the amplifier unit after the piezoelectric element is driven according to the driving signal.

According to another aspect of the present invention, there is provided an inkjet printer including: an inkjet head including a plurality of nozzles; a plurality of driving circuits respectively provided for the plurality of nozzles and generating driving signals; a plurality of piezoelectric elements respectively provided for the plurality of nozzles, receiving the driving signals, and applying pressure to ink chambers to thereby allow ink to be ejected from the plurality of nozzles; an amplifier unit amplifying a differential voltage between an output voltage of each of the plurality of driving circuits and a voltage generated in a corresponding one of the piezoelectric elements respectively provided for the plurality of nozzle; and a detecting unit detecting whether the ink is being normally ejected, based on the amplified differential voltage from the amplifier unit.

The amplifier unit may include a plurality of amplifiers respectively provided for the plurality of nozzles, and the inkjet printer further includes a switching unit selectively connecting the plurality of amplifiers and the detecting unit.

The inkjet printer may further include a first switching unit selectively inputting output voltages of the plurality of driving circuits to the amplifier unit; and a second switching unit selectively inputting voltages generated in the plurality of piezoelectric elements to the amplifier unit.

The detecting unit may detect whether the ink is being normally ejected, based on the amplified differential voltage from the amplifier unit after the piezoelectric elements are driven according to the driving signals.

BRIEF DESCRIPTION OF THE DRAWINGS

The above and other aspects, features and other advantages of the present invention will be more clearly understood from the following detailed description taken in conjunction with the accompanying drawings, in which.

DETAILED DESCRIPTION OF THE PREFERRED EMBODIMENT

Exemplary embodiments of the present invention will now be described in detail with reference to the accompanying drawings. The invention may, however, be embodied in many different forms and should not be construed as being limited to the embodiments set forth herein. Rather, these embodiments are provided so that this disclosure will be thorough and complete, and will fully convey the scope of the invention to those skilled in the art.

In addition, throughout the specification, when it is stated that a certain portion is "connected" with the other portion, the statement is intended to include a case in which a certain portion is "indirectly connected" with the other portion, having a device therebetween, as well as a case a certain portion is directly connected with the other portion. Moreover, 'including' certain constituents means that other constituents may be further included rather than excluded, unless specifically described to the contrary.

Figure 1:
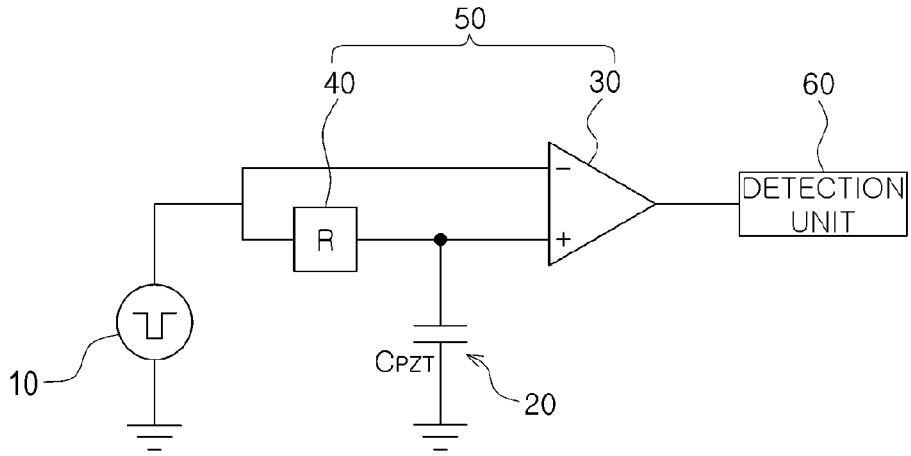
FIG. 1 is a schematic diagram illustrating a monitoring apparatus for an inkjet head according to an exemplary embodiment of the present invention.
Figure 2:
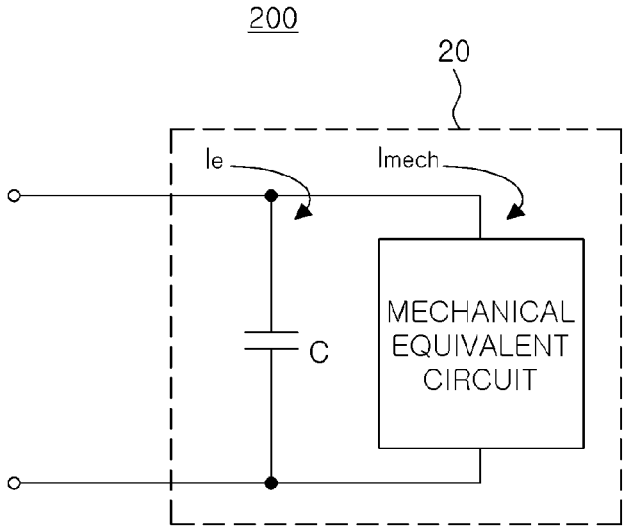
FIG. 2 is a schematic equivalent circuit diagram of a piezoelectric element according to an exemplary embodiment of the present invention.

FIG. 1 is a schematic diagram illustrating a monitoring apparatus for an inkjet head according to an exemplary embodiment of the present invention.

Referring to FIG. 1, a monitoring apparatus for an inkjet head according to an exemplary embodiment of the present invention may include a driving circuit 10, a piezoelectric element 20, an amplifier unit 30, a resistance element 40, and a detection unit 60.

The piezoelectric element 20 may be provided for each nozzle of the inkjet head. The piezoelectric element 20 converts an electrical signal received from the driving circuit 10 into mechanical energy, and thus applies pressure to an ink chamber of each nozzle, thereby enabling ink to be ejected from the nozzle.

The piezoelectric element 20 converts electrical energy into mechanical energy when ink is being ejected. Conversely, the piezoelectric element 20 may convert mechanical energy into electrical energy. Therefore, after ink is ejected, when the residual vibration of the inkjet head is applied to the piezoelectric element 20, the piezoelectric element 20 converts the residual vibration into an electrical signal and outputs the electrical signal.

When the piezoelectric element 20 is connected to the driving circuit 10, the electrical characteristics thereof are similar to those of a capacitive element. Thus, FIG. 1 illustrates the piezoelectric element 20 as a capacitor.

In more detail, the piezoelectric element 20 may be expressed as an electrical equivalent capacitor C and a mechanical equivalent circuit according to the displacement of the piezoelectric element. Here, reference symbol Ie denotes a current charged to the capacitor of the piezoelectric element 20. Reference symbol Imech denotes a current according to the displacement of the piezoelectric element 20 generated by the pressure change of the ink chamber.

When a voltage is applied to the piezoelectric element 20, the current Ie is generated by the voltage. When the applying of the voltage to the piezoelectric element 20 is completed, no more current Ie occurs, but the piezoelectric element 20 is deformed by pressure generated in the ink chamber, thereby generating the current Imech.

Here, the total current generated in the piezoelectric element 20 may be considered to be the sum of the current Ie and the current Imech. This is indicated by an equation below:

$$I = d\frac{dP}{dt} + C\frac{dV}{dt}$$

Here, C is capacitance of the piezoelectric element, V is voltage applied to the piezoelectric element, P is pressure applied to the piezoelectric element, and d is an effective acoustic piezoelectric coefficient when P is 'O'.

The amplifier unit 30 may have an inverting input terminal connected to the driving circuit 10, and a non-inverting input terminal connected to the piezoelectric element 20. Moreover, the resistance element 40 used to sense current may be connected between the driving circuit 10 and the piezoelectric element 20, and the resistance element 40 may be connected to the non-inverting input terminal of the amplifier unit 30. The amplifier unit 30 and the resistance element 40 forms a sensing unit 50.

A monitoring apparatus for an inkjet head according to another exemplary embodiment of the present invention may further include another resistance element (not shown) connected to the inverting input terminal of the amplifier unit 30. In this case, the resistance element 40 connected to the non-inverting input terminal of the amplifier 30, and another resistance element connected to the inverting input terminal of the amplifier 30 may be set to have the same resistance value.

The amplifier unit 30 may amplify a differential voltage between the output voltage from the driving circuit 10 and a voltage generated from the piezoelectric element 20 and output the differential voltage to the detection unit 60. The amplifier unit 30 may amplify the differential voltage because the level of an electrical signal generated by the piezoelectric element 20 according to the residual vibration of the inkjet head after ink is ejected is significantly smaller than that of an electrical signal outputted from the driving circuit 10.

The detection unit 60 having received the differential voltage from the amplifier unit 30, analyzes the differential voltage and determines whether the ink is being normally ejected from the nozzle, or abnormally ejected from the nozzle due to the inflow of air into the ink chamber of the nozzle. Further, the detection unit 60 may detect the abnormal ejecting of ink due to the abnormal operation of the driving circuit 10.

A method of determining whether ink is being normally ejected, in the detection unit 60, will be now explained in detail with reference to drawings.

Figure 3A:
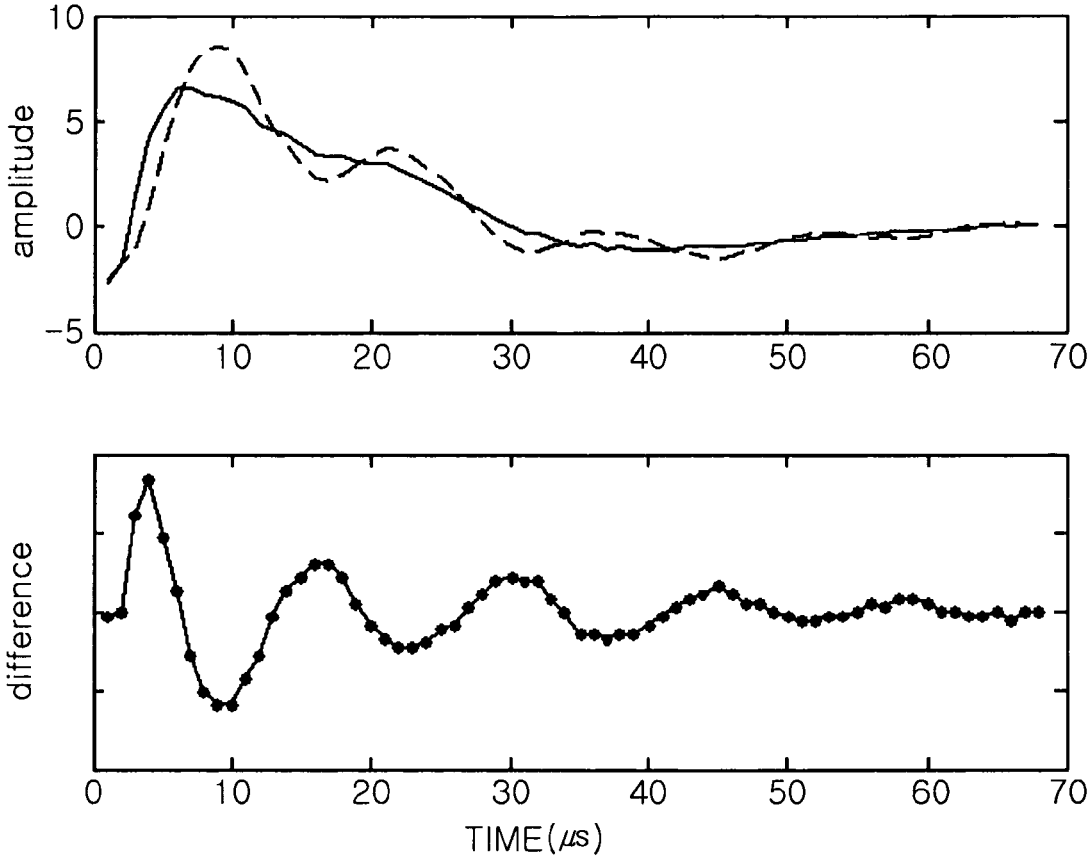
FIGS. 3A and 3B are respectively, a graph comparing signals outputted from an amplifier unit of a monitoring apparatus for an inkjet head according to an exemplary embodiment of the present invention, when ink is being normally ejected and when ink is being abnormally ejected; and a schematic diagram illustrating an abnormal state of the inkjet head in the case of FIG. 3A.
Figure 3B:
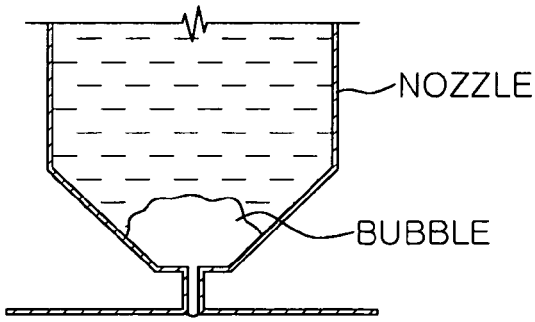
Figure 4A:
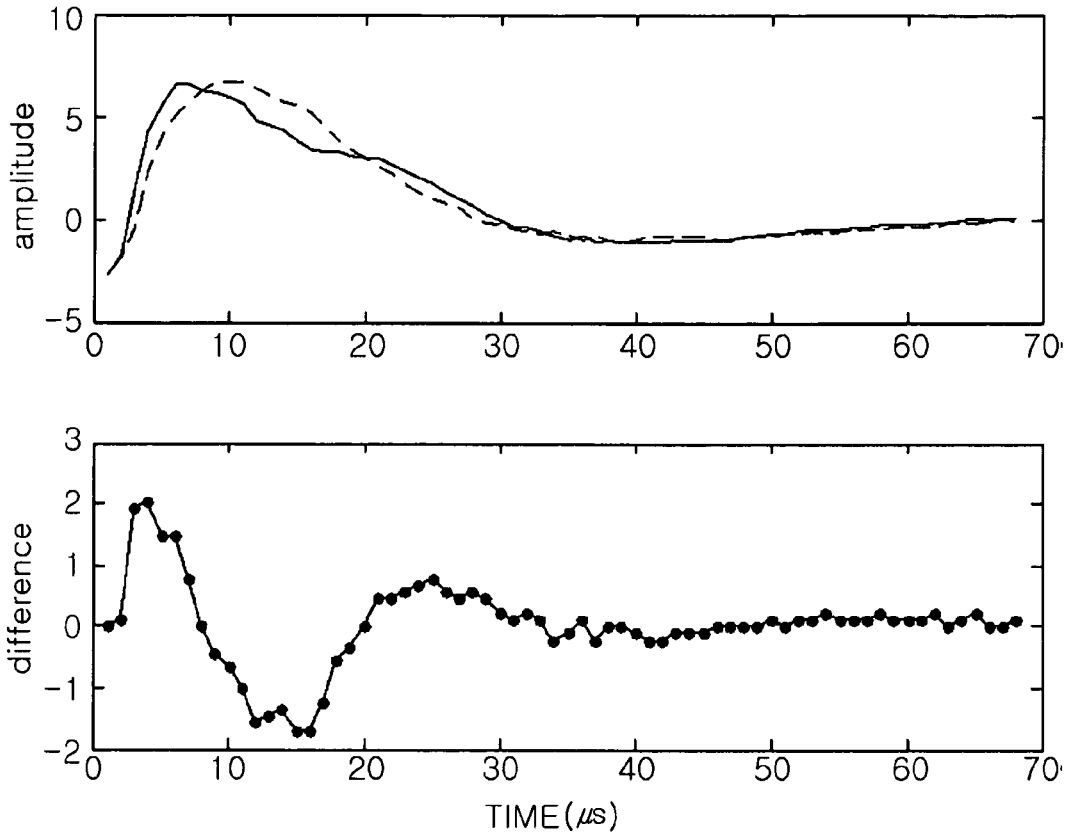
FIGS. 4A and 4B are respectively, a graph comparing signals outputted from an amplifier unit of a monitoring apparatus for an inkjet head according to an exemplary embodiment of the present invention, when ink is being normally ejected and when ink is being abnormally ejected; and a schematic diagram illustrating an abnormal state of the inkjet head in the case of FIG. 4A.
Figure 4B:
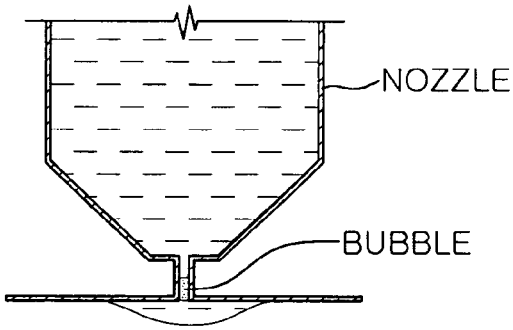

FIGS. 3A and 3B are respectively, a graph comparing signals outputted from an amplifier unit of a monitoring apparatus for an inkjet head according to an exemplary embodiment of the present invention, when ink is being normally ejected and when ink is being abnormally ejected; and a schematic diagram illustrating an abnormal state of the inkjet head in the case of FIG. 3A. FIGS. 4A and 4B are respectively, a graph comparing signals outputted from an amplifier unit of a monitoring apparatus for an inkjet head according to an exemplary embodiment of the present invention, when ink is being normally ejected and when ink is being abnormally ejected; and a schematic diagram illustrating an abnormal state of the inkjet head in the case of FIG. 4A.

In detail, in the upper graph of FIG. 3A, a solid line shows an output signal when ink is normally ejected, and a dotted line shows an output signal when ink is being abnormally ejected. The lower graph of FIG. 3A illustrates the difference of the two output signals shown in the upper graph.

Referring to FIG. 3B, since an air bubble is trapped in the end portion of a nozzle orifice, the ejecting of an ink droplet may be stopped. In addition, the amplitude of a piezoelectric element by the residual pressure wave is highly increased compared to the case in which the ink is normally ejected, so that the abnormal waveform of a detection signal is indicated to have large amplitude.

In the related art, the abnormal state of an inkjet head as shown in FIG. 3B is detected by using a bridge circuit (refer to US Patent Laid-open Publication No. 2006/0038858). However, the method of detecting the abnormal state of an inkjet head by using this bridge circuit has the following limitations.

First, the piezoelectric element is an electric device, and the greater part of the piezoelectric element is a capacitor. However, in order to make a balance with the piezoelectric element in the bridge circuit, a capacitor having the same capacity as the piezoelectric element needs to be provided. Thus, the value of capacitance is doubled, thereby causing the amount of current supplied to the head driver to be increased twofold.

Second, since the bridge circuit measures a potential difference caused by the subtle differences between respective elements, the bridge circuit always needs to be in equilibrium by setting the respective elements to the same value. However, in the case of an inkjet head, the hundreds to thousands of piezoelectric elements are provided on respective chambers, and each of the piezoelectric elements may have a different capacitance value due to the unevenness of manufacturing processes or the piezoelectric materials used therein. Thus, in the case in which bridge circuits are used, in order that each of the bridge circuits have capacitance corresponding to the respective piezoelectric elements, each bridge circuit needs to be in equilibrium so as to have a different capacitance; however, it is difficult to realize this, by considering the deviations of the respective elements.

In order to solve the above limitations, current applied to the piezoelectric element through the resistance element 40 as shown in FIG. 1 could be simply and accurately detected in the present invention, to detect a vibration generated in the piezoelectric element.

The detection unit 60 receives an output signal from the amplifier unit 30 and compares the output signal with an output signal which is previously stored in the detection unit 60 when ink is being normally ejected. As a comparison result, in the case in which the compared signals are not identical, the detection unit 60 may determine a nozzle corresponding to the output signal from the amplifier unit 30 to be a nozzle from which ink is being abnormally ejected.

To more accurately determine whether ink is being normally ejected or not, in the case in which a signal obtained by subtracting the output signal, received from the amplifier unit 30, from the output signal when ink is being normally ejected, is identical to a signal illustrated in the lower graph of FIG. 3A, the detection unit 60 may determine a nozzle corresponding to the output signal from the amplifier unit 30 to be a nozzle from which ink is being abnormally ejected. In this case, the signal illustrated in the lower graph of FIG. 3A may be stored in the detection unit 60.

Referring to FIG. 4A, a solid line and a dotted line in the upper graph of FIG. 4A, respectively show an output signal when ink is being normally ejected and an output signal when ink is being abnormally ejected. The lower graph of FIG. 4A illustrates a difference between the two outputs shown in the upper graph.

Referring to FIG. 4B, ink or a foreign substance may block the end portion of a nozzle orifice. In this case, a waveform indicating the abnormal state of the inkjet head may not have large amplitude, unlike that of FIG. 3A.

Figure 5:
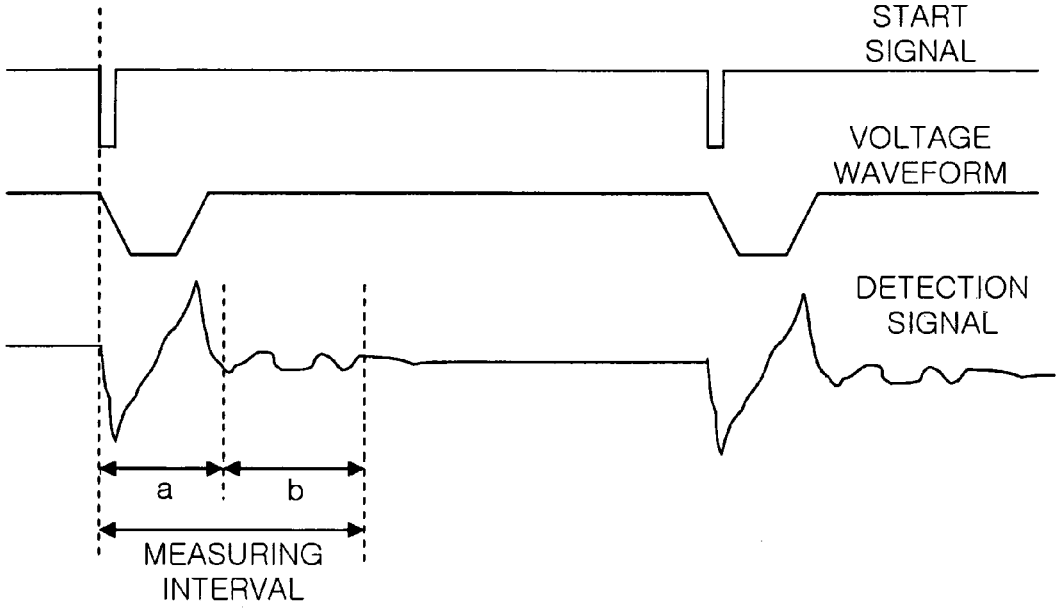
FIG. 5 is a graph illustrating signal waveforms of an operation for detecting an abnormal state of an inkjet head according to an exemplary embodiment of the present invention.
Figure 6:
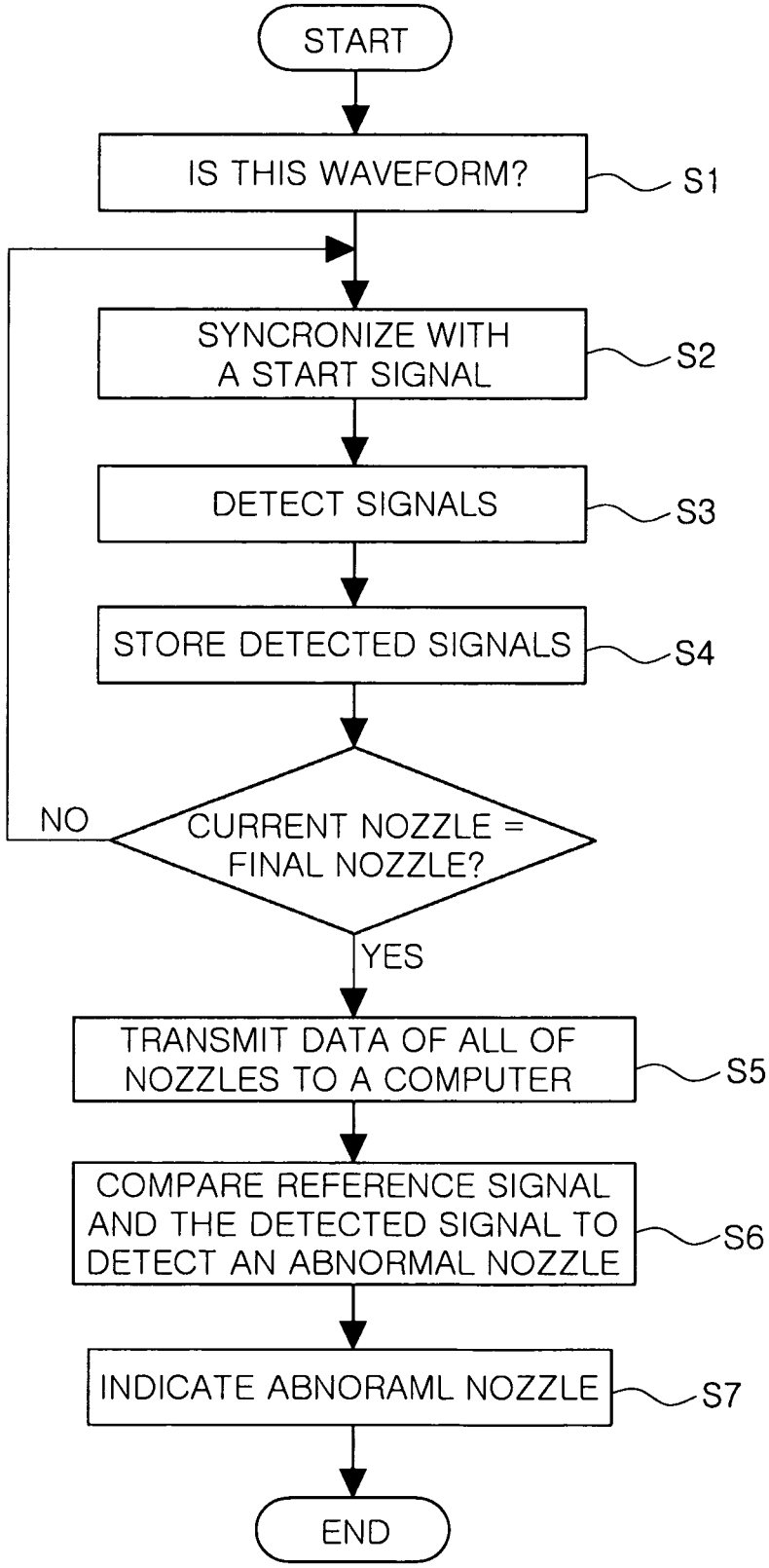
FIG. 6 is a flowchart of an operation for detecting an abnormal state of an inkjet head according to an exemplary embodiment of the present invention.

FIG. 5 is a graph illustrating signal waveforms of an operation for detecting an abnormal state of an inkjet head according to an exemplary embodiment of the present invention. FIG. 6 is a flowchart of the operation for detecting the abnormal state of the inkjet head according to the exemplary embodiment of the present invention.

Referring to FIGS. 1, 5 and 6, in operations S1 and S2, a voltage waveform from the driving circuit 10 is synchronized with a start signal and applied to the piezoelectric element 20. In operation S3, the voltage waveform of the piezoelectric element 20 may be detected. At this time, reference symbol a in measuring interval may be an interval for measuring the abnormal state as shown in FIG. 4B. Reference symbol b may be an interval for measuring the abnormal state as shown in FIG. 3B. In operation S4, measured detection signals may be stored for a comparison.

Meanwhile, the inkjet head may include a plurality of nozzles, and the aforementioned operations may be repeated up to the final nozzle by confirming whether the current nozzle is the final nozzle. The detection signals detected up to the final nozzle are stored. Then, in operation S5, S6, and S7, data of all of the nozzles is transmitted to an external computer, the waveform of a reference signal and the waveforms of the detected signals are compared to detect an abnormal nozzle, and the abnormal nozzle may be indicated to a user.

Figure 7:
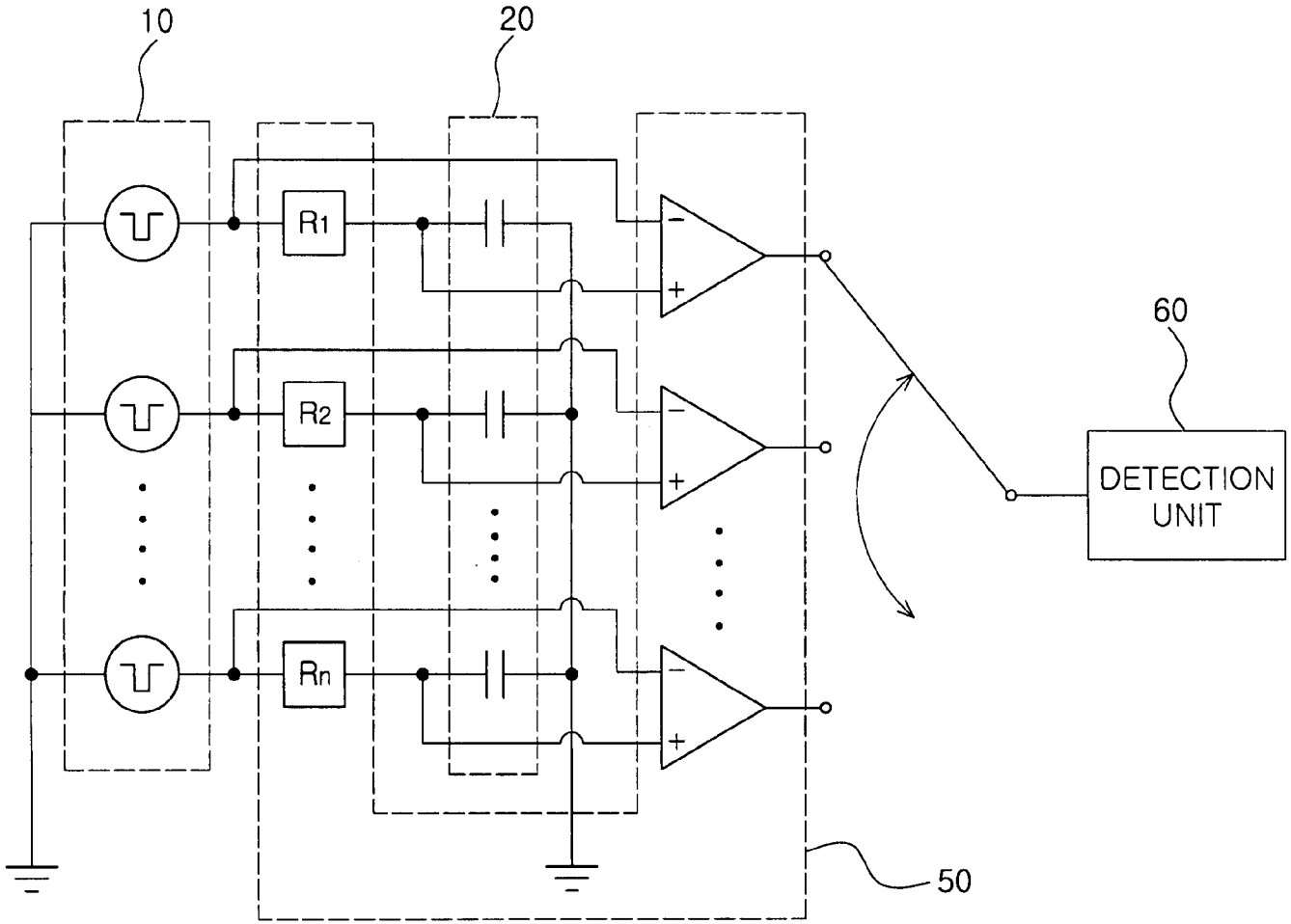
FIG. 7 is a schematic diagram illustrating a monitoring apparatus for an inkjet head according to another exemplary embodiment of the present invention.
Figure 8:
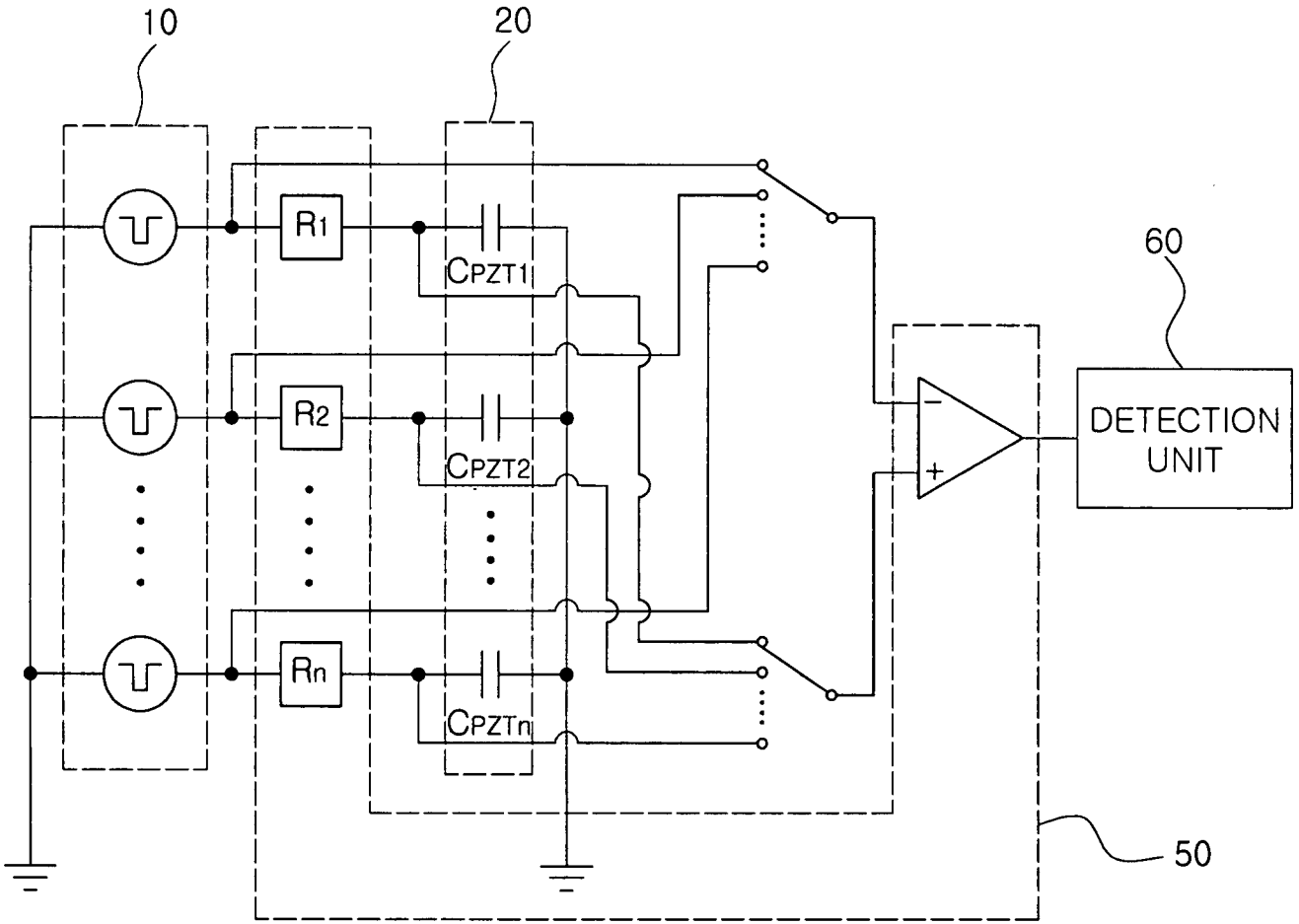
FIG. 8 is a schematic diagram illustrating a monitoring apparatus for an inkjet head according to another exemplary embodiment of the present invention.

FIG. 7 is a schematic diagram illustrating a monitoring apparatus for an inkjet head according to another exemplary embodiment of the present invention. FIG. 8 is a schematic diagram illustrating a monitoring apparatus for an inkjet head according to another exemplary embodiment of the present invention.

In the monitoring apparatus for an inkjet head according to another exemplary embodiment of the present invention shown in FIG. 7, in order to allow the monitoring apparatus to be applied to the inkjet head including a plurality of nozzles, the sensing unit 50 may include a plurality of amplifiers corresponding to the plurality of nozzles and the monitoring apparatus may further include a switching unit between the sensing unit 50 and the detection unit 60 to connect the plurality of amplifiers to one detection unit 60. At this time, according to the operation of the switching unit, the output terminals of the plurality of amplifiers are in turn connected to the input terminal of the detection unit 60, so that the detection unit 60 may scan output signals from the plurality of amplifiers in turn, thereby detecting a nozzle from which ink is being abnormally ejected.

Unlike the exemplary embodiment of FIG. 7, in a monitoring apparatus for an inkjet head according to another exemplary embodiment of the present invention shown in FIG. 8, the sensing unit 50 may include a single amplifier therein. Switching units are respectively included on the two input terminals of the single amplifier within the sensing unit 50, thereby sequentially receiving inputs with respect to the plurality of nozzles. Since the amplifier within the sensing unit 50 is directly connected to the detection unit 60, the detection unit 60 may sequentially scan outputs with respect to the plurality of nozzles similarly to the embodiment shown in FIG. 7.

As set forth above, according to the exemplary embodiments of the invention, the abnormal state of an inkjet head could be simply detected according to the operation waveform of a piezoelectric element.

As set forth above, according to exemplary embodiments of the invention, there is provided a monitoring apparatus for an inkjet head and an inkjet printer including the same, which are capable of amplifying a difference between an output of a driving circuit for driving a piezoelectric element provided for a nozzle of the inkjet head and an output generated by the piezoelectric element according to the residual vibration of the inkjet head after ink is ejected, to thereby simply determine whether the ink is being normally ejected and to simply detect whether a head driver is abnormal, based on vibration waveform in the inkjet head.

While the present invention has been shown and described in connection with the exemplary embodiments, it will be apparent to those skilled in the art that modifications and variations can be made without departing from the spirit and scope of the invention as defined by the appended claims.

What is claimed is:

1. A monitoring apparatus for an inkjet head, the monitoring apparatus comprising:

a resistance element;

a driving circuit configured to generate a driving signal to be supplied to one end of the resistance element;

a piezoelectric element arranged between an other end of the resistance element and ground, and configured to apply pressure to an ink chamber according to the driving signal provided through the resistance element;

an amplifier unit configured to amplify a differential voltage between both ends of the resistance element; and a detecting unit configured to detect whether ink is being normally ejected, based on the amplified differential voltage from the amplifier unit.

2. The monitoring apparatus of claim 1, wherein the detecting unit detects whether the ink is being normally ejected from the nozzle, by comparing the amplified differential voltage from amplifier unit with a previously inputted differential voltage of the amplifier unit when the ink is being normally ejected.

3. The monitoring apparatus of claim 1, wherein the detecting unit detects whether the ink is being normally ejected, based on the amplified differential voltage from the amplifier unit after the piezoelectric element is driven according to the driving signal.

4. An inkjet printer comprising:

an inkjet head including a plurality of nozzles;

a plurality of resistance elements respectively provided for the plurality of nozzles;

a plurality of driving circuits respectively provided for the plurality of nozzles and configured to generate driving signals to be supplied to one end of each of the plurality of resistance elements;

a plurality of piezoelectric elements respectively provided for the plurality of nozzles, arranged between an other end of each of the plurality of resistance elements and ground, and configured to apply pressure to ink chambers according to the driving signals provided through each of the plurality of resistance elements;

an amplifier unit configured to amplify a differential voltage between both ends of each of the plurality of resistance elements; and a detecting unit detecting whether ink is being normally ejected, based on the amplified differential voltage from the amplifier unit.

5. The inkjet printer of claim 4, wherein the amplifier unit comprises a plurality of amplifiers respectively provided for the plurality of nozzles, wherein the inkjet printer further comprises a switching unit selectively connecting the plurality of amplifiers and the detecting unit.

6. The inkjet printer of claim 4, further comprising:

a first switching unit selectively inputting output voltages of the plurality of driving circuits to the amplifier unit; and a second switching unit selectively inputting voltages generated in the plurality of piezoelectric elements to the amplifier unit.

7. The inkjet printer of claim 4, wherein the detecting unit detects whether the ink is being normally ejected, based on the amplified differential voltage from the amplifier unit after the piezoelectric elements are driven according to the driving signals.

* * * * *